United States Patent [19]

Selep et al.

[11] 4,397,657

[45] Aug. 9, 1983

[54] GAS LOCK SYSTEM FOR CHARGING PARTICLES INTO A PRESSURIZED GASIFICATION REACTOR

[75] Inventors: Andrew Selep, Hales Corners, Wis.; Yeshwant K. Bhide, Allentown, Pa.

[73] Assignee: Allis-Chalmers Corporation, Milwaukee, Wis.

[21] Appl. No.: 369,811

[22] Filed: Apr. 19, 1982

[51] Int. Cl.[3] ..... C10J 3/30

[52] U.S. Cl. ..... 48/86 R; 414/220

[58] Field of Search ..... 48/86 R; 414/189, 218, 414/220, 195

[56] References Cited

U.S. PATENT DOCUMENTS

| | | | |
|---|---|---|---|
| 2,585,472 | 2/1982 | Kennedy . | |
| 2,688,416 | 9/1954 | Skretting | 414/220 |
| 2,858,212 | 10/1968 | Durant et al. | 414/220 |
| 3,610,476 | 10/1971 | Starrett | 414/220 |
| 4,244,705 | 1/1981 | Seidl et al. | 48/86 R |

*Primary Examiner*—Peter F. Kratz

*Attorney, Agent, or Firm*—Timothy R. Conrad

[57] ABSTRACT

An apparatus is disclosed for feeding a continuous supply of carbonaceous material into a pressurized reactor for producing a product gas from the material and which contains toxic and flammable gases. The apparatus comprises a first rotary gas lock for receiving the material from ambient atmospheric condition. The first lock is supplied with a flow of nitrogen as a sealing gas to prevent air from entering the lock and the apparatus. The first lock transfers the material to a second rotary gas lock which in turn transfers the material to a screw conveyor for delivery to the interior of the reactor. The second lock is supplied with a flow of a clean product gas as a buffer gas. The clean product gas supplied to the second lock is at a pressure greater than the pressure in the reactor and prevents flow of gases from the reactor to the apparatus. An exhaust is maintained between the first and second locks which draws off nitrogen and clean product gas with the nitrogen and product gas constituting a noncombustible mixture of gases in the exhaust. Means are provided for preventing entrainment of particulate material between the first and second gas locks.

11 Claims, 2 Drawing Figures

GAS LOCK SYSTEM CHARGING PARTICLES INTO A PRESSURIZED GASIFICATION REACTOR

BACKGROUND OF THE INVENTION

1. Field of the Invention

The present invention relates to material feed apparatus for charging carbonaceous material into a pressurized gasifier for processing the material into a combustible fuel gas. More specifically, the present invention relates to an apparatus comprising two rotary gas locks serially arranged to transfer coal from ambient atmospheric conditions to the interior of a pressurized reactor containing toxic and combustible gases.

2. Description of the Prior Art

In the prior art, rotary gas locks are well known for transferring pulverulent material from a region at one pressure to a region at a different pressure. An example of such a rotary lock is shown in U.S. Pat. No. 2,585,472 to Kennedy dated Feb. 12, 1952. Additionally, the use of such rotary locks to transfer coal or other carbonaceous material to a gasification reactor is known as shown in U.S. Pat. No. 4,244,705 to Seidl et al dated Jan. 13, 1981.

In Seidl, three rotary gas locks are serially arranged to receive coal and transfer the coal through the locks and into a screw conveyor for delivery to the interior of a gasification reactor. A buffer gas prevents gas within the reactor from entering the gas lock apparatus and an exhaust is provided preventing the buffer gas from entering the atmosphere.

SUMMARY OF THE INVENTION

It is an object of the present invention to provide an apparatus for feeding carbonaceous material to a gasification reactor which is pressurized with a toxic and combustible gas.

It is a further object of the present invention to provide an apparatus for feeding carbonaceous material to the gasifier with the apparatus having two rotary gas locks arranged in series for transfer of the material from ambient atmospheric conditions, through the first gas lock, through the second gas lock and into the pressurized reactor.

It is yet a further object of the present invention to provide an apparatus comprising two rotary gas locks for feeding carbonaceous material to a gasification reactor which uses clean gas produced in the reactor as a buffer gas in the apparatus and nitrogen as a seal gas to prevent air from flowing into the apparatus to prevent a combustible mixture of gases within the apparatus.

According to a preferred embodiment of the present invention, there is provided an apparatus for feeding carbonaceous material to the interior of a rotary kiln gasifier. The apparatus comprises two rotary gas locks arranged in series for accepting material from ambient atmospheric conditions and transferring the material to a screw conveyor for delivery to the gasifier for conversion into a product gas.

A first rotary gas lock initially receives the material. The first gas lock is provided with a flow of nitrogen as a seal gas to prevent air from entering the gas lock apparatus. A second gas lock receives material from the first lock and transfers the material to the screw conveyor. The second gas lock is supplied with a flow of clean product gas at a pressure greater than the pressure in the reactor thereby preventing flow of gases in the reactor toward the gas lock apparatus. An exhaust line between the first and second gas locks, maintained at a pressure less than ambient atmospheric pressure, draws off the clean product gas and nitrogen with the nitrogen and product gas presenting a noncombustible mixture of gases in the exhaust.

A collar between the first and second gas lock intercepts gas flowing from the second gas lock toward the first gas lock preventing the gas from entraining carbonaceous particulates falling toward the second gas lock. Nitrogen is used as a purge gas to fill transfer compartments of the first gas lock voided by material discharged from the compartment and product gas is used to purge transfer compartments of the second gas lock.

DESCRIPTION OF THE PREFERRED EMBODIMENT

Figures 1, 2:
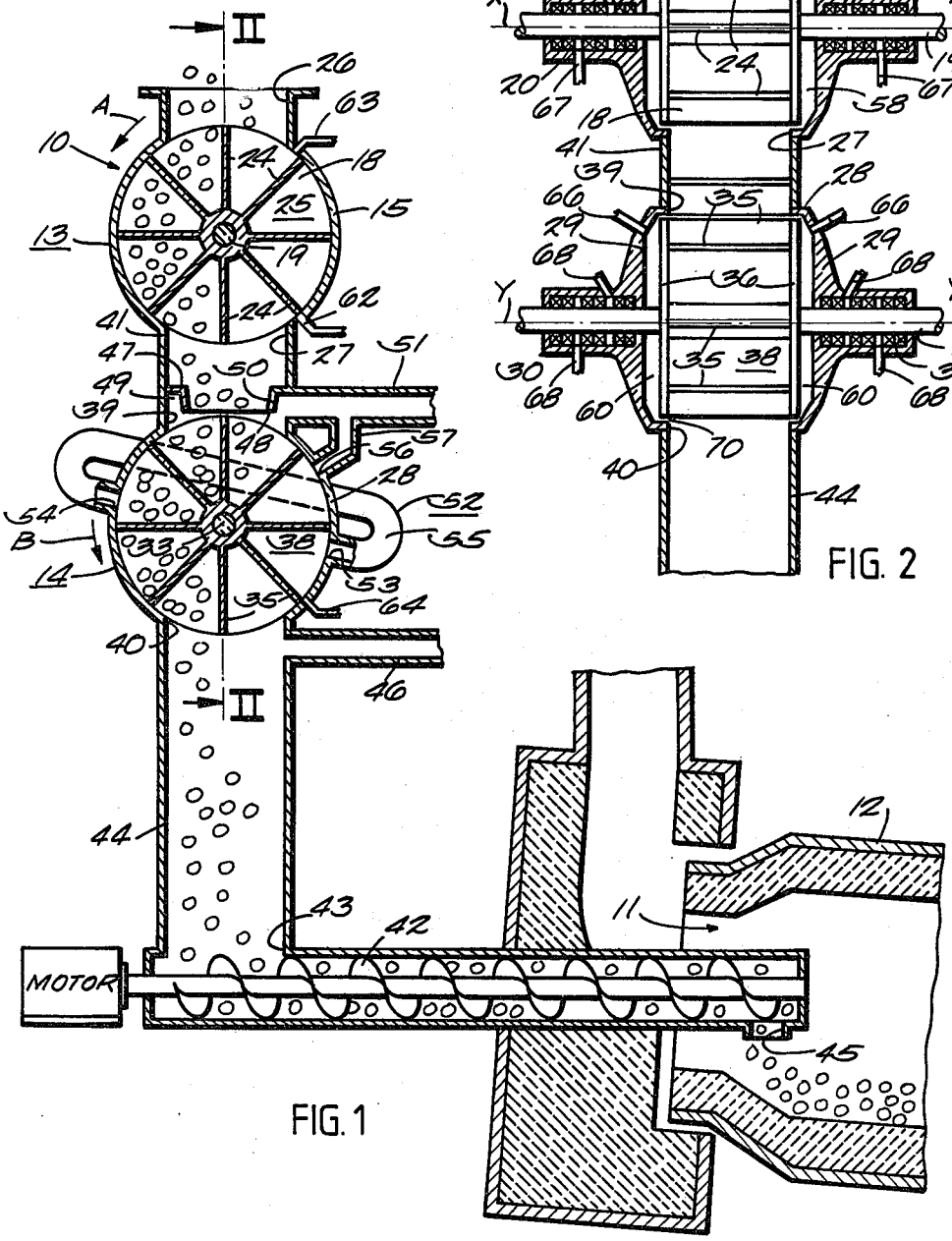
FIG. 1 is a sectional view of an apparatus for feeding carbonaceous material to a pressurized reactor; and, FIG. 2 is a view taken along line II—II of FIG. 1.

Referring to FIG. 1, there is shown a material feed apparatus 10 for providing a continuous feed of particles of solid carbonaceous material, such as coal, to a material inlet end 11 of a pressurized rotary kiln 12. Within the kiln 12, the coal is processed to produce a combustible fuel gas therefrom. It will be appreciated that a process for converting coal into a combustible fuel gas forms no part of this invention and is more fully described in commonly assigned copending patent application of P. G. Garside, Ser. No. 264,479, filed May 18, 1981. As disclosed in the aforesaid patent application of P. G. Garside, the gasifier is maintained at an internal pressure significantly higher than ambient atmospheric pressure (for example, 60 to 180 pound per square inch higher than atmospheric pressure) with an internal temperature in excess of 800° F. Furthermore, the combustible fuel gas produced by such a process is toxic and, in the region of material inlet end 11, laden with vaporized tars. Apparatus (not shown) draws the gas from kiln 12 and further processes the gas into a clean combustible product gas.

The material feed apparatus 10 comprises a first rotary gas lock 13 and a second rotary gas lock 14 arranged in series relationship. The first rotary gas lock includes a generally cylindrical hollow housing 15 having a generally horizontal cylindrical axis X—X. End bells 16 are provided on free ends of housing 15. A rotor 18 having a shaft 19 is mounted within housing 15 with shaft 19 rotating within seals 20 in end bells 16 and rotatable about axis X—X. Seals 20 are of the dual lantern ringpacking gland type well known in the art. Rotor 18 further includes a plurality of spaced-apart radially extending rotor blades 24 fixed to shaft 19. End discs 22 are secured to shaft 19 abutting free ends of blades 24. Rotor blades 24, shaft 19, end discs 22 and housing 15 all mutually cooperate to define a plurality of material transferring compartments 25 within the first rotary gas lock 13. End discs 22 and end bells 16 cooperate to define end cavities 58. Housing 15 is provided a material inlet opening 26 disposed above shaft 19 and operable to receive particles of coal from a weigh feeder (not shown) or other suitable delivery device. Housing 15 is further provided with a material outlet opening 27 disposed beneath shaft 19 operable to permit passage of coal particles from first rotary gas lock 13. A motor (not shown) drives shaft 19 in a rotational direction indicated by the arrow, A, in FIG. 1 causing material transferring compartments 25 to travel alternately from inlet 26 to outlet 27 and back to inlet 26.

Similarly, second rotary gas lock 14 is provided with a housing 28 having end bells 29 having seals 30 operable to receive a shaft 33 of a rotor 34 with shaft 33 rotatable about a generally horizontal axis Y—Y coaxial with a cylindrical axis of housing 28. A plurality of radially extending rotor blades 35 and end discs 36 cooperate with housing 28 to define a plurality of material transferring compartments 38 within second rotary gas lock 14. End discs 36 and end bells 29 cooperate to define end cavities 60. Housing 28 is provided with a material inlet opening 39 above shaft 33 and a material outlet opening 40 beneath shaft 33. A motor (not shown) drives shaft 33 in a rotational direction indicated by the arrow, B, in FIG. 1 with material transferring compartments 38 alternately traveling from inlet 39 to outlet 40 and back to inlet 39.

In the arrangement of material feed apparatus 10, first rotary gas lock 13 and second rotary gas lock 14 are arranged in vertical series relationship with first gas lock 13 arranged above second gas lock 14. A connecting conduit 41 is provided connecting material outlet 27 of first gas lock 13 with the material inlet 39 of second gas lock 14 in gas-tight material flow communication. A screw conveyor 42 having a material inlet 43 is provided beneath the second rotary gas lock 14. Material outlet 40 of second gas lock 14 and material inlet 43 of the screw conveyor 42 are connected in gas-tight material flow communication by means of a discharge conduit 44. Screw conveyor 42 is provided with a material outlet 45 within the interior of kiln 12 at the material inlet end 11 of kiln 12.

A buffer gas conduit 46 is provided in gas flow communication with the discharge conduit 44 beneath material outlet 40. Buffer gas conduit 46 is connected to a source (not shown) of a buffer gas, such as the clean product gas, and is operable to deliver buffer gas to discharge conduit 44 at a pressure greater than the pressure within kiln 12.

Connecting conduit 41 is provided with a collar 47 therein. Collar 47 surrounds the interior perimeter of conduit 41 with an end 48 of collar 47 being spaced from conduit 41 to define an annular chamber 49 surrounding the perimeter of conduit 41 with the annular chamber 49 having an annular opening 50 facing the material inlet 39 of second gas lock 14. An exhaust conduit 51 is connected to connecting conduit 41 with exhaust conduit 51 in fluid flow communication with annular chamber 49. Suitable means (not shown) are provided to maintain the pressure within exhaust conduit 51 less than ambient atmospheric pressure.

Second rotary gas lock 14 is provided with a crossvent 52 having a first port 53 extending through housing 28 in communication with material transferring compartments 38 which have passed material outlet 40 but which have not yet arrived at material inlet 39. A second port 54 is provided extending through housing 28 in communication with material transferring compartments 38 which have passed the material inlet 39 but which have not yet arrived at the material outlet 40. A by-pass conduit 55 connects second port 54 with first port 53 in gas flow communication. Second rotary gas lock is further provided with an exhaust port 56 extending through housing 28 in communication with material transferring compartments 38 which have passed first port 53 but which have not yet arrived at material inlet 39. A gas conduit 57 connects exhaust port 56 with the exhaust conduit 51 in gas flow communication.

First rotary gas lock 13 is provided with a seal port 63 extending through housing 15 at material inlet 26 on a side of inlet 26 in communication with compartments 25 which have discharged their material load and have not yet received a fresh load. Seal port 63 is connected to a source (not shown) of a nontoxic seal gas containing no free oxygen, such as nitrogen, for supplying the seal gas under pressure to port 63. First rotary gas lock 13 is further provided with a purge port 62 extending through housing 15 in communication with compartments 25 which have discharged material through outlet 27 and before the compartment has passed outlet 27. Purge port 62 is connected to a source (not shown) of a purge gas containing no free oxygen, such as nitrogen, for supplying the purge gas under pressure to port 62.

Second rotary gas lock 14 is provided with a stripping port 64 extending through housing 28 at outlet 40 in communication with material transferring compartments 38 which have discharged material through outlet 40 and prior to the compartment passing outlet 40. Port 64 is connected to source of a pressurized stripping gas containing no free oxygen, such as steam.

As shown in FIG. 2, first rotary gas lock 13 is provided with cleansing ports 65 through end bells 16 in communication with end cavities 58. Ports 65 are connected to a source of the seal gas under a pressure higher than the pressure at which the seal gas is supplied to the inlet 26 of first gas lock 13 through port 63. Second rotary gas lock 14 is provided with cleansing ports 66 through end bells 29 in communication with cavities 60. Ports 66 are connected to a source of the buffer gas under a pressure higher than the pressure at which buffer gas is supplied to the outlet 40 of second gas lock 14.

First rotary gas lock 13 is provided with seal cleansing ports 67 extending through end bells 16 into communication with seals 20. Cleansing ports 67 are connected to a source (not shown) of a nontoxic cleansing gas containing no free oxygen, such as nitrogen, under a pressure greater than the pressure of the sealing gas supplied to end cavities 58 through ports 65. Second rotary gas lock 14 is provided with seal cleansing ports 68 extending through end bells 29 into communication with seals 30. Ports 68 are connected to a source of a cleansing gas containing no free oxygen, such as nitrogen, under a pressure greater than the pressure of the buffer gas supplied to end cavities 60 through ports 66.

In the operation of the material feed apparatus 10, coal is delivered to the material inlet 26 of first rotary gas lock 13. Rotation of rotor 18 carries coal within the material transferring compartments 25 through first gas lock 13 to the material outlet 27. At outlet 27, the coal drops from compartments 25 into material conduit 41. After the coal has been discharged, the compartments 25 continue in a rotational path of travel to material inlet 26 and receive a fresh charge of coal. Coal discharged from outlet 27 flows through conduit 41 and is received at the inlet 39 of the second rotary gas lock 14. Coal admitted to inlet 39 is received by the moving material transfer compartments 38 which in turn transport the coal through second gas lock 14 to the material outlet 40 where the coal drops from compartments 38 into the discharge conduit 44. After the coal has been discharged, the compartments continue in a rotational path of travel to inlet 39 where the compartments receive a fresh charge of coal from material conduit 41. Coal discharged from the second rotary gas lock 14 into conduit 44 flows to the inlet 43 of screw conveyor 42. Screw conveyor 42 transports the coal to outlet 45 where the coal is dropped into the material inlet end 11 of kiln 12.

Clean product gas supplied to the outlet 40 of second gas lock 14 at a pressure greater than the pressure within kiln 12 prevents the tar-laden gas in the region of material inlet end 11 from flowing to the second rotary gas lock 14. The nitrogen supplied to the inlet 26 of first rotary gas lock 13 through port 63 provides an atmosphere of nitrogen at inlet 26 preventing oxygen-containing ambient air from entering first rotary lock 13. Nitrogen supplied through port 63 also serves to strip rotor blades 24 of coal which may cling to the blades. Exhaust conduit 51, maintained at a pressure less than ambient atmospheric pressure draws nitrogen and product gas from connecting conduit 41 with the nitrogen and product gas constituting a noncombustible mixture in exhaust conduit 51. Nitrogen supplied as a purge gas to compartments 25 of first rotary lock 13 through port 62 fills the compartments after the coal is discharged preventing a surge of buffer gas into the compartment and insuring the maintenance of a nitrogen atmosphere in first rotary gas lock 13.

Clean product gas delivered to the outlet 40 of the second gas lock 14 enters the material transfer compartments 38 after the compartments have discharged the coal within the compartments. The high pressure product gas enters the compartments and is subsequently exhausted from the compartments in sequential steps. First, cross-vent 52 relieves approximately 40% of the pressure in compartments 38 traveling away from outlet 40 by permitting the product gas in the compartment to flow to coal-charged compartments moving toward outlet 40. Second, the remaining pressure in the compartment is relieved by exhaust port 56 and gas conduit 57 into exhaust conduit 51 thereby preventing a surge of pressurized product gas entering connecting conduit 41 when compartments 38 reach inlet 39. Accordingly, preventing a surge of product gas at inlet 39 prevents entrainment of coal dust in material conduit 41.

Nitrogen supplied to end cavities 58 of first gas lock 13 at a pressure greater than the pressure of nitrogen supplied to inlet 26 prevents coal fines from passing to cavities 58 and seals 20 through clearances between end discs 22 and housing 15 such as at 59. Similarly, buffer gas supplied to end cavities 60 of second gas lock 14 at a pressure greater than the pressure of clean product gas supplied to outlet 40 prevents coal fines from entering end cavities 60 and seals 30 through clearances between end discs 36 and housing 28 such as at 70. First gas lock seals 20 and second gas lock seals 30 are further cleansed by nitrogen admitted to the seals through ports 67 and 68, respectively.

Flow of gas from end cavities 60 of the second gas lock 14 through clearance 70 is prevented from interferring with the downward flow of coal in connecting conduit 41 by collar 47. Upward flow about the perimeter of inlet 39 is directed into the annular chamber 49 through the annular opening 50 and exhausted through exhaust conduit 51.

Finally, steam admitted to compartments 38 of second gas lock 14 through port 64 strips the blades 35 of coal that may be clinging to the blades 35.

Accordingly, a continuous flow of coal is fed to kiln 12 through the material feed apparatus 10 without permitting tar-laden gas to enter the rotary lock and without creating a combustible mixture of gases within the locks or in the exhaust conduit.

From the foregoing detailed description of the present invention, it has been shown how the objects of the invention have beeen attained in a preferred manner. However, modification and equivalents of the disclosed concepts such as readily occur to those skilled in the art are intended to be included in the scope of this invention. Thus, the scope of the invention is intended to be limited only by the scope of the claims as are, or may hereafter be, appended hereto.

The embodiments of the invention in which an exclusive property or privilege is claimed are defined as follows:

1. An apparatus for providing a continuous feed of particles of solid carbonaceous material from a source exposed to ambient oxygen containing atmosphere to a pressurized reactor which processes said material to a combustible product gas; comprising:

a. first and second rotary gas locks; each of said rotary gas locks having a housing with an inlet operable to receive a flow of said solid material and an outlet operable to discharge a flow of said material; means within said housing cooperating with said housing to define a plurality of material transferring compartments; said means being movably mounted for movement of said compartments alternately from said inlet to said outlet and back to said inlet;

b. said first and second rotary gas locks arranged in series relationship with said inlet of said first rotary gas lock arranged to receive a flow of said material from a source at ambient atmosphere; material conduit means for connecting said outlet of said first rotary gas lock with said inlet of said second rotary gas lock in gas-tight material flow communication; means for receiving material discharged from said outlet of said second rotary gas lock and introducing said material to said reactor;

c. means for supplying a flow of buffer gas containing essentially no free oxygen to said outlet of said second rotary gas lock at a pressure greater than the pressure within said reactor;

d. means connected to said first rotary gas lock housing adjacent said inlet for supplying a flow of nontoxic seal gas containing essentially no free oxygen to said inlet of said first rotary gas lock at a pressure greater than ambient atmospheric pressure;

e. means for exhausting said buffer gas from said inlet of said second rotary gas lock and exhausting said seal gas from said outlet of said first rotary gas lock, said means for exhausting comprising an exhaust gas conduit connected to and in gas flow communication with said material conduit whereby said carbonaceous material is transferred from ambient oxygen containing atmosphere through said rotary gas locks by said compartments and into said pressurized reactor with said buffer gas flooding said second rotary gas lock and said seal gas maintaining a nontoxic and noncombustible atmosphere in said first rotary lock to maintain noncombustible mixtures of gases within both of said rotary gas locks and within said exhaust means.

2. An apparatus according to claim 1 comprising means for supplying a nontoxic purge gas containing essentially no free oxygen to said material transferring compartments of said first rotary gas lock after said compartments have discharged material through said outlet of said first rotary gas lock and before said compartments have passed said outlet whereby said compartments are filled with said purge gas preventing a draft of said buffer gas into said first rotary lock and maintaining a nontoxic atmosphere in said first rotary gas lock.

3. An apparatus according to claim 2 comprising means for exhausting buffer gas from said material transferring compartments of said second rotary gas lock after said compartments have passed said outlet of said second rotary gas lock and prior to passing said inlet of said second rotary gas lock.

4. An apparatus according to claim 3 wherein said means within said housing cooperating with said housing to define a plurality of material transferring compartments comprises a rotor having a shaft mounted within said housing for rotation about an axis coaxial with said shaft; a plurality of rotor blades extending radially from said shaft and coplanar with said axis; a pair of end discs secured to said shaft with one side of said discs abutting free ends of said rotor blades; and means for providing a gas-tight seal between ends of said shaft and said housing while permitting rotation of said ends within said housing; said shaft, end discs, rotor blades and housing mutually cooperating to define a plurality of material transferring compartments disposed about the circumference of said shaft and movable about a rotational path of travel alternately from said inlet to said outlet and back to said inlet and said end discs and said housing cooperating to define a pair of annular end cavities on sides of said end discs remote from said compartments.

5. An apparatus according to claim 4 comprising means for providing flow of said seal gas to said end cavities of said first rotary gas lock at a pressure higher than said pressure at which said seal gas is supplied to said inlet of said first rotary gas lock.

6. An apparatus according to claim 5 comprising means for providing a flow of said buffer gas to said end cavities of said second rotary gas lock at a pressure higher than said pressure at which said buffer gas is supplied to said outlet of said second rotary gas lock.

7. An apparatus according to claim 6 comprising a. means for providing a flow of a nontoxic cleansing gas containing essentially no free oxygen to said means for providing a seal between said shaft and said housing of said first rotary gas lock at a pressure higher than the pressure of said seal gas supplied to said end cavities of said first rotary gas lock; and, b. means for providing a flow of said cleansing gas to said means for providing a seal between said shaft and said housing of said second rotary gas lock at a pressure higher than the pressure of said buffer gas supplied to said end cavities of said second rotary gas lock.

8. An apparatus according to claim 7 comprising means for collecting gases flowing from said inlet of said second rotary gas lock toward said outlet of said first rotary gas lock around a perimeter of said inlet of said second rotary gas lock.

9. An apparatus according to claim 8 comprising means for supplying a flow of a stripping gas containing essentially no free oxygen to said second rotary gas lock for stripping carbonaceous material clinging to said rotor blades after said compartments have passed said outlet of said second rotary gas lock.

10. An apparatus according to claim 9 further comprising a. a cross vent having a first port extending through said housing of said second gas lock in communication with compartments after said compartments have passed said outlet and before said compartments have reached said inlet; a second port extending through said housing in communication with compartments after said compartments have passed said inlet and before said compartments have reached said outlet; a bypass conduit connecting said first port with said second port in gas flow communication; and, b. an exhaust port extending through said housing of said second gas lock in communication with compartments after said compartments have passed said first port and before said compartments have reached said inlet; a gas conduit connecting said exhaust port with said exhaust conduit in fluid flow communication.

11. An apparatus according to claim 10 wherein said means for collecting gases flowing from said inlet of said second rotary gas lock toward said outlet of said first rotary gas lock comprises a perimetric collar within said material conduit having an end away from said second rotary gas lock inlet affixed to said conduit and having a free end facing said inlet in spaced relation to said conduit; said collar and conduit cooperating to define an annular chamber having an annular opening facing said inlet of said second rotary gas lock; said chamber in gas flow communication with said exhaust conduit.

* * * * *